US009099289B2

(12) United States Patent
Makarov

(10) Patent No.: US 9,099,289 B2
(45) Date of Patent: Aug. 4, 2015

(54) TARGETED ANALYSIS FOR TANDEM MASS SPECTROMETRY

(71) Applicant: Thermo Fisher Scientific (Bremen) GmbH, Bremen (DE)

(72) Inventor: Alexander Makarov, Bremen (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

(21) Appl. No.: 14/622,444

(22) Filed: Feb. 13, 2015

(65) Prior Publication Data

US 2015/0155147 A1 Jun. 4, 2015

Related U.S. Application Data

(63) Continuation of application No. 14/128,330, filed as application No. PCT/EP2012/061746 on Jun. 19, 2012, now Pat. No. 8,957,369.

(30) Foreign Application Priority Data

Jun. 23, 2011 (GB) ..... 1110662.2

(51) Int. Cl.
*H01J 49/26* (2006.01)
*H01J 49/40* (2006.01)
*H01J 49/00* (2006.01)

(52) U.S. Cl.
CPC ..... *H01J 49/0081* (2013.01); *H01J 49/0031* (2013.01); *H01J 49/40* (2013.01)

(58) Field of Classification Search
CPC ..... H01J 49/0031; H01J 49/004; H01J 49/40; H01J 49/0027; H01J 49/0045; H01J 49/0072; H01J 49/0077; H01J 49/0081; H01J 49/063; H01J 49/065; H01J 49/38; H01J 49/0009; H01J 49/005; H01J 49/009; H01J 49/0095; H01J 49/025; H01J 49/0481; H01J 49/06; H01J 49/061; H01J 49/22; H01J 49/26; H01J 49/282; H01J 49/423; H01J 49/424; H01J 49/425; H01J 49/428; G01N 33/6848; G01N 33/6818
See application file for complete search history.

(56) References Cited

U.S. PATENT DOCUMENTS 6,781,121 B1 * 8/2004 Davis et al. ..... 250/287
7,196,324 B2 * 3/2007 Verentchikov ..... 250/287

(Continued)

OTHER PUBLICATIONS

Gallien, et al., "Selected Reaction Monitoring Applied to Proteomics," J. Mass Spectrom. 2011, vol. 46, No. 3 (2011), pp. 298-312.

(Continued)

*Primary Examiner* — David A Vanore
(74) *Attorney, Agent, or Firm* — Charles B. Katz

(57) ABSTRACT

A tandem mass spectrometer and method are described. Precursor ions are generated in an ion source and an ion injector injects ions towards a downstream ion guide via a single or multi reflection TOF device that separates ions into packets in accordance with their m/z. A single pass ion page in the path of the precursor ions between the ion injector and the ion guide is controlled so that (only a subset of precursor ion packets, containing precursor ions of interest, is allowed onward transmission to the ion guide. A high resolution mass spectrometer is provided for analysis of those ions, or their fragments, which have been allowed passage through the ion gate. The technique permits multiple m/z ranges to be selected from a wise mass range of precursors, with optional fragmentation of one or more of the chosen ion species.

16 Claims, 5 Drawing Sheets

(56) References Cited

U.S. PATENT DOCUMENTS

| | | | | |
|---|---|---|---|---|
| 7,312,442 | B2 * | 12/2007 | Hansen | 250/282 |
| 7,446,312 | B2 * | 11/2008 | Rather | 250/288 |
| 7,482,581 | B2 | 1/2009 | Lange et al. | |
| 7,534,622 | B2 * | 5/2009 | Hunt et al. | 436/173 |
| 7,749,769 | B2 * | 7/2010 | Hunt et al. | 436/173 |
| 7,767,960 | B2 * | 8/2010 | Makarov | 250/292 |
| 7,999,223 | B2 | 8/2011 | Makarov et al. | |
| 8,076,637 | B2 * | 12/2011 | Pringle et al. | 250/282 |
| 8,586,914 | B2 * | 11/2013 | Makarov et al. | 250/282 |
| 2004/0108455 | A1 * | 6/2004 | Mordehai | 250/288 |
| 2007/0084998 | A1 * | 4/2007 | Franzen et al. | 250/287 |
| 2007/0176091 | A1 * | 8/2007 | Lange et al. | 250/288 |
| 2009/0283675 | A1 * | 11/2009 | Franzen | 250/288 |
| 2010/0059673 | A1 * | 3/2010 | Makarov et al. | 250/283 |
| 2010/0084547 | A1 | 4/2010 | Pringle et al. | |
| 2011/0111513 | A1 * | 5/2011 | Baumann et al. | 436/89 |
| 2012/0261568 | A1 * | 10/2012 | Coon et al. | 250/282 |
| 2013/0105681 | A1 * | 5/2013 | Kovtoun | 250/282 |
| 2014/0042312 | A1 * | 2/2014 | Richardson | 250/282 |
| 2014/0061457 | A1 * | 3/2014 | Berdnikov et al. | 250/281 |
| 2014/0061460 | A1 * | 3/2014 | Hauschild et al. | 250/283 |

OTHER PUBLICATIONS

Thermo Scientific brochure, "Thermo Scientific Q Exactive," (2011), XP055050967. Retrieved from the Internet (Jan. 24, 2013): URL:http://admin.planetorbitrap.com/data/uploads/ZFS1308011944434_63426_QExactive_060211L.pdf4_63426_QExactive_060211 L.pdf.

* cited by examiner

TARGETED ANALYSIS FOR TANDEM MASS SPECTROMETRY

CROSS-REFERENCE TO RELATED APPLICATIONS

The present application is a continuation under 35 U.S.C. §120 and claims the priority benefit of co-pending U.S. patent application Ser. No. 14/128,330, filed Dec. 20, 2013, which is a National Stage application under 35 U.S.C. §371 of PCT Application No. PCT/EP2012/061746, filed Jun. 19, 2012. The disclosures of each of the foregoing applications are incorporated herein by reference.

FIELD OF THE INVENTION

This invention relates to a method and an apparatus for targeted analysis of ions using tandem mass spectrometry.

BACKGROUND OF THE INVENTION

Triple quadrupole mass spectrometry is a well established analytical technique for the targeted analysis of complex mixtures. In a triple quadrupole mass spectrometer, ions are generated from an ion source and injected into a first quadrupole analyzer. Here, a narrow mass range (m/z)) is selected and this narrow mass range enters a second stage which comprises a gas filled collision cell. Fragment ions generated by collisions with gas enter a second quadrupole analyzer where a particular fragment is selected for detection.

The triple quadrupole technique permits the isolation of precursor and corresponding fragment ions of interest, thus providing a robust quantitative method for target analysis, in the case that the targets for analysis are known but are present at very low levels compared to other analytes.

A drawback of this analytical method is that only a narrow window of m/z is isolated in the first stage, with all other m/z being lost on the quadrupole rods. This wasteful operation hinders rapid quantitation analysis where multiple target compounds need to be analyzed within a limited time. The quadrupoles must in each case be set to accept a different range of m/z, and effective duty cycles are quite low (perhaps 0.1%-10%, depending upon the number of targets).

An alternative to the traditional triple quadrupole mass spectrometer involves simultaneous acquisition of all fragments from all precursors in one high resolution, high mass accuracy spectrum. Once that single spectrum has been obtained, it can be searched to try to identify ions of a target m/z. Analyzers having sufficient resolution and mass accuracy to allow implementation of this effect include the Orbitrap™ electrostatic trap analyzer and the time-of-flight (TOF) analyzer. However, even with such instruments (resolving power >50,000 to 100,000 and mass accuracy below 2 ppm or even better), the extremely large ranges of concentrations in modern targeted analysis experiments mean that existing so-called "all mass" analyzers cannot rival the triple quadrupole device in terms of linearity, dynamic range and detection limits for a specific m/z of interest. For TOF analyzers, the limitations result from low transmission and detection electronics constraints. For the Orbitrap™, the difficulty is primarily the limited charge capacity of any external trapping device.

One way of improving throughput of mass analysis is to carry out MS/MS where the ion beam is split into packets in accordance with the packets' m/z. A first packet is then fragmented without loss of another packet, or in parallel with another packet. The splitting of the ion beam into packets can be achieved by the use of a scanning device which stores ions of a broad mass range. Suitable devices for implementing this scanning are a 3D ion trap, such as is disclosed for example in WO-A-2003/103,010, a linear trap having radial ejection as is described in U.S. Pat. No. 7,157,698, a pulsed ion mobility spectrometer (see, for example, WO-A-00/70335 or US-A-2003/0213900), a slowed down linear trap (see WO-A-2004/085,992) or a multi-reflection time of flight mass spectrometer such as described in WO-A-2004/008,481.

In each case, the first stage of mass analysis is followed by fast fragmentation in a collision cell for example (preferably, a collision cell having an axial gradient), or by a pulsed laser. The resulting fragments are analyzed using, for example, another TOF mass spectrometer, but on a much faster time scale than the scanning duration (known as "nested times"). The performance is still however compromised because only a very limited time is allocated for each scan (typically, 10-20 ps).

These approaches of so-called "2-Dimensional MS" seem to provide throughput without compromising sensitivity, unlike the more traditional multi-channel MS/MS arrangement wherein a number of parallel mass analyzers (typically ion traps) are used to select one precursor each and then scan out the fragments from that precursor to an individual detector such as the ion trap array disclosed in U.S. Pat. No. 5,206,506 or the multiple traps disclosed in US-A-2003/089,846.

All known 2-Dimensional MS techniques suffer however from the relatively low resolution of precursor selection (not better that unit resolution) and the relatively low resolving power of fragment analysis (not more than a few thousands). Also, these known 2-Dimensional MS techniques are based on the use of trapping devices to provide a high duty cycle, and the cycle time is defined by the cycle time of the slowest analyzer. Modern ion sources can produce ion currents of the order of hundreds of picoAmps, that is, in excess of $10^9$ elementary charges per second. Thus, if the full cycle of scanning through the entire mass range of interest is 5 ms, then such trapping devices should in principle be able to accumulate up to 5 million elementary charges and still allow efficient precursor selection.

WO-A-2008/059246 describes an arrangement that permits high performance simultaneous isolation of multiple ion species, either for subsequent detection or fragmentation. In the disclosed arrangement, ions are injected into a multi-reflection electrostatic trap which reflects ions back and forth along an axis. Ions of species of interest are isolated by appropriate control of an electrostatic gate which diverts ions in accordance with their period of oscillation within the trap, along first or second ion paths respectively.

Against this background, the present invention provides, in a first aspect, a method of tandem mass spectrometry in accordance with claim 1. The invention also extends to a tandem mass spectrometer in accordance with claim 21.

The invention is based upon the realisation that targeted analysis does not require all MS/MS spectra to be acquired independently. The instrument merely needs to deliver separated and detectable peaks for the ion species of interest. These separated precursors may have their populations mixed together again and then acquired in a single high resolution spectrum. This so called parallel reaction monitoring (PRM) allows quantification of multiple low intensity analytes in parallel, thus greatly increasing the detection limits over triple quadrupoles in massive targeting experiments.

The ions selected at the ion gate for onward transmission to the ion guide may remain in an unfragmented state upon arrival at the ion guide, and downstream of that as they are analyzed in the high resolution mass analyser. This mode greatly extends the capabilities of the above described "all-mass analysis" technique, by opening up the possibility of storing m/z of different intensities by using different duty cycles. In that way, both the unfragmented and fragmented spectra are obtained with a range of intensities that has been reduced by 1-3 orders of magnitude. For example, low-intensity peaks might be transmitted to the high resolution mass analyser after every injection, whilst high-intensity peaks might only be transmitted during 0.5-1% of all injections. The various relatively small mass range spectra obtained (each typically having its own particular attenuation scheme) can optionally then be stitched together (for example by using the technique described in WO-A-2005/093783). With a final spectrum corrected for these differences in transmissions, such "spectrum stitching" allows for a significant extension to the dynamic range of analysis.

In addition, the technique employed provides sufficient time to fragment ions, and in particular provides sufficient time to employ such recently developed "slow" techniques as Electron Transfer Dissociation (ETD) or infrared multiphoton dissociation (IRMPD).

Thus in accordance with some preferred embodiments of the present invention, some or all of the precursor ions allowed to pass through the ion gate may be fragmented downstream thereof. In one preferred embodiment, the ion guide comprises a fragmentation cell and an ion trap (which may optionally be a second ion trap) downstream of that fragmentation cell. Precursor ions of interested are then selected by the ion gate, and passed to the fragmentation cell where some or all of the precursor ions are fragmented. The fragment ions (and any remaining precursor ions) are then analysed by the high resolution mass analyser. Most preferably, the fragment ions are stored in the (second) ion trap so that, for example, particular low abundance species can be augmented in that (second) ion trap through multiple cycles of the technique, prior to high resolution mass analysis. In additional or alternative embodiments, augmentation of precursor ions may take place as well or instead, in the ion accumulation means, either by using a fragmentation cell but operating it in a low energy mode so that ions are not fragmented, and/or by bypassing the fragmentation cell (or omitting it entirely) and employing a second ion trap.

Thus, multiple m/z ranges can be selected (rather than 1, as in quadrupole mass filters) from a wide mass range of precursors. Each selected precursor species can be fragmented—optionally at a respective optimal energy—and the fragments can then be combined in a single broad spectrum fragment population. This single fragment population can then be analyzed in a high resolution mass analyzer such as a TOF, an orbital electrostatic trap such as the Orbitrap™, or FT-ICR mass spectrometer. Thus a method and apparatus is proposed that addresses on the one hand the limited space—charge capacity of trapping analyzers, and the limited dynamic range of TOFs on the other, by selecting a limited but nevertheless plural number of ion species of analytical interest for fragmentation and subsequent parallel analysis. For example, between 10 and 100 precursor species could be analyzed together in this technique.

The present invention may provide for a method of tandem mass spectrometry, comprising the steps of a) generating precursor ions in an ion source; b) trapping the precursor ions in an ion trap; c) ejecting the precursor ions from the ion trap towards an ion guide, via an ion gate, so that the precursor ions arrive at the said ion gate only once on their passage to the said ion guide, the precursor ions arriving as a temporally separated plurality of ion packets each containing ions of a respective one of a plurality of different ion species; d) controlling the ion gate so as to sequentially select from the plurality of ion packets arriving at the ion gate, a subset of a plurality of ion packets deriving from a subset of precursor ion species of interest; e) mixing the selected subset of a plurality of ion packets in the ion guide; and f) analyzing the resulting ion population derived from the mixed selected subset of ion packets in a high resolution mass analyzer.

It may also provide for a tandem mass spectrometer comprising an ion source for generating precursor ions; an ion trap arranged downstream of the ion source, for trapping precursor ions from the ion source; a single pass ion gate, arranged in a path of precursor ions ejected from the ion trap towards a downstream ion guide, the precursor ions arriving at the said ion gate as a plurality of temporally separated ion packets each containing ions of a respective one of a plurality of different ion species; an ion gate controller configured to control the single pass ion gate so as to permit passage of only a subset of ion packets containing a respective subset of a plurality of precursor ion species of interest; wherein the ion guide is configured to receive precursor ions that are permitted to pass through the single pass ion gate; the tandem mass spectrometer further comprising: a high resolution mass analyzer arranged to analyze the ions or their fragments.

BRIEF DESCRIPTION OF THE DRAWINGS

The invention may be put in practice in a number of ways, and some embodiments will now be described by way of example only and with reference to the accompanying drawings in which.

DETAILED DESCRIPTION OF PREFERRED EMBODIMENTS

Figure 1:
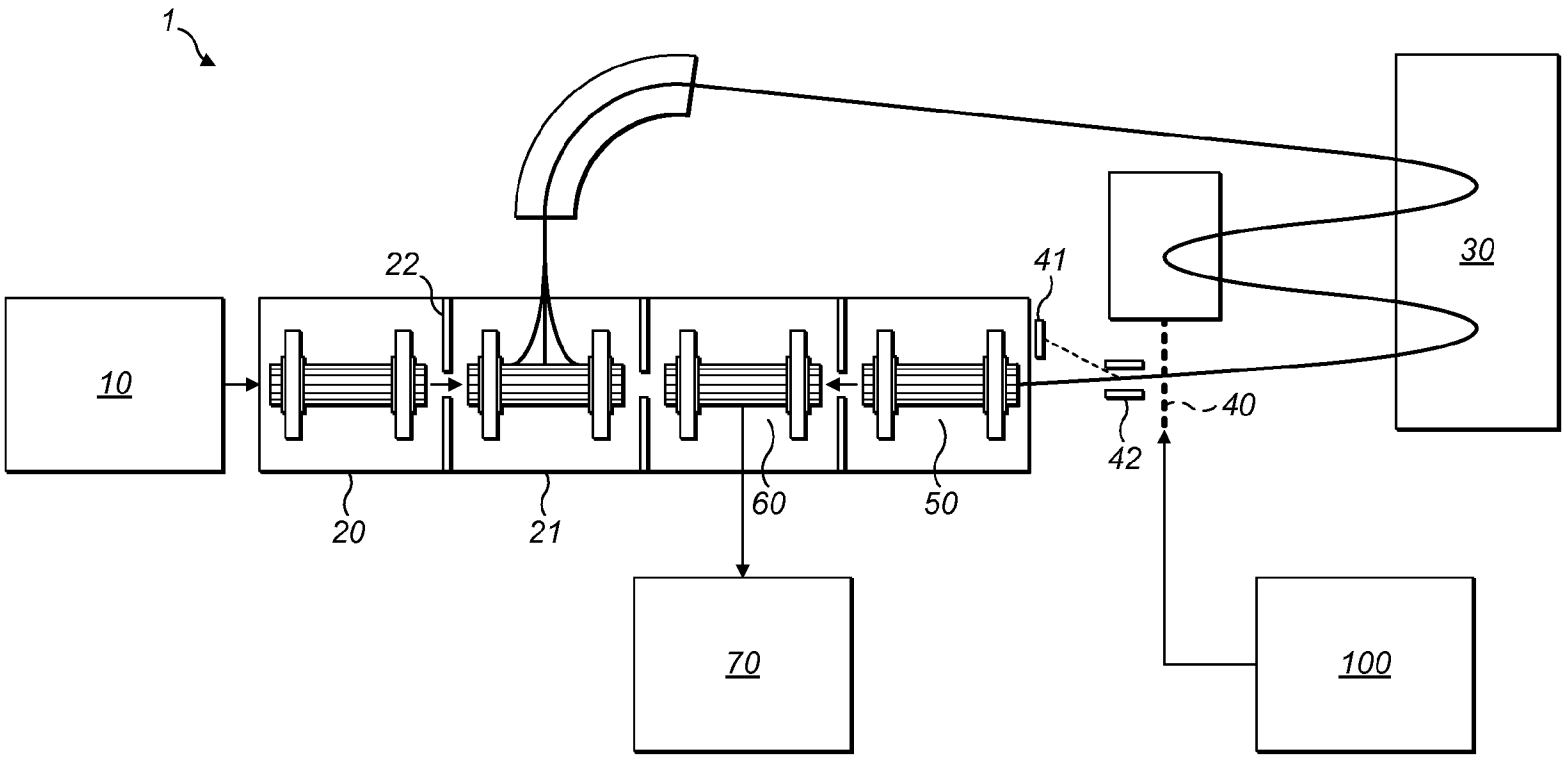
FIG. 1 shows a first embodiment of a tandem mass spectrometer for targeted analysis of ions.

Referring first to FIG. 1, a tandem mass spectrometer 1 is shown. The mass spectrometer 1 comprises an ion source 10, such as an electrospray ion source or a MALDI ion source, which generates a continuous or pulsed stream of charged particles (precursor ions) to be analysed. The ions from the ion source are introduced into a first stage of rf-only storage (ion trap) 20 immediately followed by a second stage of rf-only storage (ion trap) 21. Both the first and second ion traps 20, 21 are formed by linear rf-only multipoles filled with gas and separated by an aperture 22. The aperture gates the incoming ion flow. Most preferably, the second ion trap 21 is a so called curved linear trap or c-trap—for example of the type described in WO-A-2008/081334. The rf frequency applied to the multipoles of the first and second stages 20, 21 is preferably between about 2 and 5 MHz. The pressure in the second ion trap 21 is chosen so as to provide ion cooling within a short time period, preferably less than 1 ms. This time period corresponds to a pressure of in excess of about $3\text{-}10\times10^{-3}$ mbar of nitrogen. In preference, a narrow gas jet from the ion source 10 is employed.

The voltage of the aperture 22 is reduced to allow ions to pass into the second ion trap 21 and then is increased again to retain (store) remaining precursor ions from the ion source in the first ion trap 20.

After no more than 1 millisecond of cooling time, ions in the second ion trap 21 are ejected orthogonally to the axis of that second ion trap 21. The axis of the second ion trap 21 is, for the purposes of this description, the axis along which the trap rods are elongated. Ejection may be achieved in a number of ways.

Figure 2:
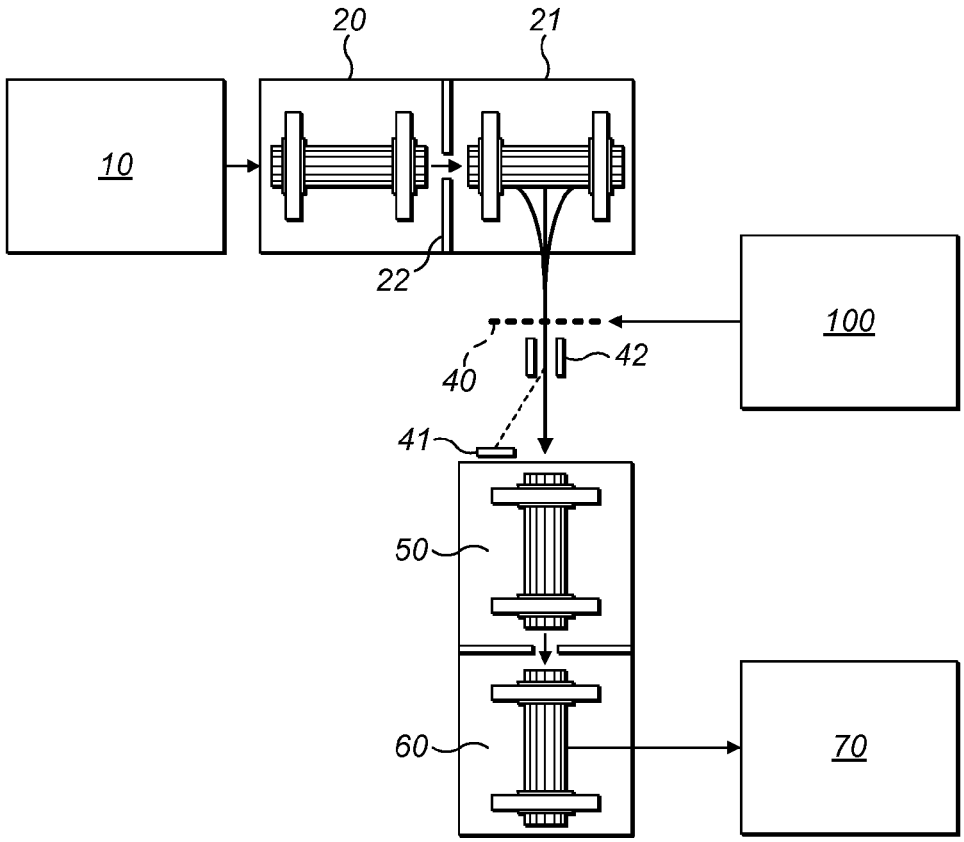
FIG. 2 shows a second embodiment of a tandem mass spectrometer for targeted analysis of precursor ions.

Firstly, ions may be ejected orthogonally by applying a DC voltage across the rf rods of the second ion trap 21, but without switching off the rf voltages applied to those rods. Alternatively, the same technique may be applied, but also accompanied by rapid switching off of the rf voltages. This technique is described in U.S. Pat. No. 7,498,571, the contents of which are incorporated by reference. In that case, it is preferable that the second ion trap 21 is a C-trap as in WO-A-2008/081,334. Another alternative to permit orthogonal ejection from the second ion trap 21 is to apply a dipolar excitation to stretched rf rods as described in U.S. Pat. No. 5,420,425. The amplitude of dipolar excitation may be scanned to provide between 2 and $10\times10^5$ amu/second mass scanning speed. The preferred arrangement of tandem mass spectrometer for this variant of orthogonal ejection is shown in FIG. 2 and will be described in further detail in connection with that Figure below. Still another arrangement for orthogonal pulsed ejection out of the trap 21 is described in U.S. Pat. No. 8,030,613.

Although preferred embodiments of the present invention employ orthogonal ejection from the second ion trap 21, it is also possible for ions to be ejected axially from the second ion trap 21. However, this arrangement typically allows a lower space charge of the ejected pulse. The space charge limit of the second ion trap preferably reaches between 1 and $3\times10^6$ elementary charges. This corresponds to an allowed ion flow of between 1 and $3\times10^9$ elementary charges per second, equivalent to an ion current of between 200 and 600 pA. This matches the typical brightness of modern ion sources such as the electrospray and MALDI ion sources described above.

Following orthogonal ejection from the second ion trap 21, ions are directed through an optional electric sector 25 into a single- or multi-reflection time of flight (MR-TOF) analyzer 30 to allow time of flight separation of ions in accordance with their mass to charge ratio, whilst maintaining a relatively compact package. In alternative embodiments, a multi-sector time of flight mass analyser (e.g. MULTUM), or a multi-deflection TOF, or an orbital time of flight mass analyser may be used as analyser 30. Suitable devices are described in WO-A-2009/081143 or WO-A-2010/136534.

Downstream of the MR-TOF 30 is located an ion gate 40. In the embodiment of FIG. 1, the ion gate 40 is located at the focal point of the MR-TOF analyzer 30. Precursors of different mass to charge ratio (m/z) arrive at different moments in time at the gate 40. The gate 40 is under the control of a controller 100. The controller controls the gate 40 so as (in the arrangement shown in FIG. 1) to allow precursor ions of analytical interest to pass on a desired trajectory into a fragmentation cell 50. All undesired ions are deflected onto an ion stop (or electrometer) 41 using voltage pulses applied to the ion gate 40 under the control of the controller 100. The ion gate 40 itself may be implemented as a simple deflector, or alternatively, as a Bradbury-Nielsen gate (see Phys. Rev. Vol. 49, No5, p388-393) 1936)). Most preferably, the ion gate 40 is gridless. Optionally, an additional pulsing device 42 may be employed to reduce the energy spread. This technique is described in U.S. Pat. No. 7,858,929, the contents of which are incorporated by reference.

The ion gate 40 and the pulsing device 42 may, optionally, be integrated into an energy lift which increases the potential (relative to the flight tube) to a level sufficient for transfer to a downstream collision cell 50, for ions which are in the vicinity of the ion gate 40.

The ion species to be selected can be deduced by first obtaining a panoramic spectrum of precursor ions. The relative intensities of precursor ions in that panoramic spectrum can also advantageously be used to provide for automatic gain control. In particular, in order to adjust the numbers of precursor ions and their fragments relative to one another, so as to provide similar relative abundances, some of the precursor ion species may be transmitted during only a single cycle of the tandem mass spectrometer, whereas other species may be transmitted in multiple cycles. This may be further understood by way of a simple example. Consider a panoramic spectrum of precursor ions in which a first ion species, species 1, has a relative abundance of approximately 40× the relative abundance of a second precursor ion species, species 2. In order that roughly similar numbers of packets of ion species 1 and ion species 2 are ultimately analyzed, ions of ion species 1 will only be allowed to pass through the ion gate 40 during one of forty cycles of the arrangement of FIG. 1. By "cycle" is meant the emptying of second ion trap 21 with subsequent time of flight separation and gating at ion gate 40 into the fragmentation cell 50. By contrast, ions of ion species 2, having a relative abundance $1/40^{th}$ that of ion species 1, will be allowed to pass through the ion gate 40 in each of forty cycles of the spectrometer 1. It will of course be understood that the relative timing of the multiple cycles is not critical: that is provided over a plurality of cycles of the spectrometer 1 the appropriate number of precursor ions is accumulated, it does not typically matter during which of those cycles each individual ion species is accumulated.

As an alternative to this 'digital' dosing of ions, an 'analogue' dosing is also possible, wherein the ion gate 40 provides not "on/off" switching of the ion beam but rather controllable attenuation of beam intensity by variable voltage. This dependence of attenuation on voltage could be calibrated using a calibration mixture and then used for real analytes.

In both variants, in the final output spectra, measured intensities are preferably scaled back by these attenuation factors to provide accurate quantitative representation. It is possible to stitch together adjacent relatively narrow mass range spectra to produce a broader mass range ("panoramic") spectrum. One suitable technique for doing this is described in WO-A-2005/093783. With a final spectrum corrected for these differences in transmissions, such a stitched panaromic spectrum permits a greatly extended dynamic range of analysis.

In preference, in the arrangement of FIG. 1, between 10 and 100 separate ion species (different m/z) are selected for a given analysis, depending upon the experiment being undertaken. Analytes are desirably selected in parallel with their internal calibrants, though as explained above, the number of cycles might be different, in accordance with the difference in intensities of the precursor ions in a precursor ion spectrum.

The collision cell 50 into which a precursor ion species are selectively gated is preferably a gas filled multipole with a DC field to collect ions at the end of the collision cell 50, where they mix. The collision cell 50 interfaces with a high resolution mass analyzer 70, with the optional use of an external ion trapping device 60 between the collision cell 50 and the high resolution mass analyzer 70. If the energy spread of ions can be reduced down to a few tens of eV, then nitrogen or argon gas may be used as a collision gas within the collision cell 50.

However, for energy spread of several tens of eV or above, it is preferable to employ helium as a collision gas as it allows much higher collision energy.

After all of the selected precursor ions have been fragmented and cooled in the collision cell 50, they are transferred, via the optional external device 60, into the high resolution mass analyzer 70. By "high resolution analyzer" is meant any device capable of providing mass analysis with a resolving power in the tens or hundreds of thousands, such as (but not limited to) an orbital electrostatic trap, such as an Orbitrap™ analyzer, a TOF analyzer of any type, such as an orthogonal-acceleration TOF analyzer, with or without an ion mirror, a multi-reflection time of flight mass analyzer, a multi-sector time of flight mass analyzer, a multi-deflection time of flight mass analyzer, or, alternatively, a Fourier transform mass analyzer, or otherwise. The optimum setting of resolving power depends on the complexity of the resulting mixture, and typically should be at least 10,000, and preferably at least 20,000, even for simple mixtures. For several tens of overlapping MS/MS spectra, it is anticipated that optimum resolving power will exceed 50,000.

Where the high resolution mass analyzer 70 is an Orbitrap™ mass analyzer, the optional external device 60 is present and is preferably an rf-only storage trap such as a c-trap, again as described in WO-A-2008/081334. In that case, multiple ejection pulses from the second ion trap 21 are fragmented in the fragmentation cell, the fragments then being accumulated in the c-trap 60. Following accumulation of all of the fragments in the c-trap 60, they are injected as a single pulse into the Orbitrap analyzer 70 for acquisition as a single spectrum.

Alternatively, where the high resolution mass analyzer 70 is a TOF mass analyzer, then fragment ions in the collision cell 50 may be continuously leaked from that collision cell 50, the ion stream being continuously sampled at a frequency of between 1 and 100 kHz by an orthogonal accelerator for continuous acquisition. For long flight lengths and/or multi reflection TOFs, again a c-trap or other rf storage device may be used as the external device 60. It is not necessary, in that case, to synchronise the operation of the injection of the fragment ions into the TOF mass analyzer 70, with ejection from the second ion trap 21.

As still a further option, the ions may be transferred without fragmentation into the external device 60. That is, ions are allowed to pass through the fragmentation cell 50 without fragmentation, or alternatively they may be caused to bypass the fragmentation cell 50. This can be achieved by reducing the amplitude of the rf voltage on the rods of the fragmentation cell 50, or by using an additional ion path (not shown) with rf only transport multipoles. This is the preferable mode for obtaining a pre-scan with correct (unscaled) intensities of precursor ions.

As a result of the technique described above, each spectrum obtained by the high resolution mass analyzer 70 represents the parallel (i.e. simultaneous) acquisition of fragments spectra from between 10 and 100 precursor ion species, with each precursor having roughly similar numbers of ions by using the automatic gain control (AGC) technique described. This results in turn in an increase of duty cycle of mass selection by a factor G, where G is similar to the number of precursor ion species selected for parallel acquisition and analysis. Such an increase in duty cycle represents a significant gain in analysis time and sensitivity.

FIG. 2 shows an alternative arrangement of a tandem mass spectrometer for high throughput targeted analysis of precursor ions. Components common to FIGS. 1 and 2 are labelled with like reference numerals. In FIG. 2, ions are once again generated by an ion source 10 and introduced into a first stage of rf-only ion storage (ion trap) 20. An aperture 22 separates the first ion trap 20 from a second stage of rf-only multipole (second ion trap) 21.

As with the embodiment of FIG. 1, ions are allowed to pass from the first and second ion trap by lowering the voltage on the aperture 22, the voltage then being raised again once the second ion trap 21 is filled.

In the embodiment of FIG. 2, then, ions are ejected orthogonally from the second ion trap 21 directly into the fragmentation cell 50 without the use of an MR-TOF 30 as is employed in the embodiment of FIG. 1. This may be achieved by applying a dipolar excitation to the stretched rf rods of the trap 21 as described in U.S. Pat. No. 5,420,425. The amplitude of dipolar excitation may be scanned to provide between 2 and $10\times10^5$ amu/second mass scanning speed. Of course, an ion gate 40 is provided between the second ion trap 21 and the fragmentation cell 50, along with, optionally, a pulsing device 41 and an ion stop 42 to receive ions deflected by the ion gate 40 when they are not of analytical interest and are not to be injected into the collision cell 50.

In contrast to the arrangement of FIG. 1, the ion gate 40 in the arrangement of FIG. 2 is arranged immediately downstream of the second ion trap 21 (there being no MR-TOF analyzer to provide a focal point in the arrangement of FIG. 2). Nevertheless, ions of different mass to charge ratio (different species) arrive at different moments of time at the gate 40 in the arrangement of FIG. 2, so that only ions of analytical interest are allowed to pass into the fragmentation cell 50. Typically, mass windows down to a few amu (e.g. 1 to 4) could be gated in this way.

Following fragmentation of the precursor ions entering the fragmentation cell, they are injected into an external device 60. From here they are in turn injected into a high resolution mass analyzer 70 for production of a composite mass spectrum of all fragment species together.

In the embodiment of FIG. 2, it is further possible to transfer precursor ions of interest (by diverting ions not of interest through control of the ion gate 40 by controller 100) into the external device 60 without fragmentation. Transfer without fragmentation into the external device 60 may be performed at reduced RF amplitudes or, optionally, along an additional ion path through rf only transport multipoles (not shown in FIG. 2).

The requirement of high throughput of the second ion trap 21 may be relaxed if some additional removal of intense ion peaks can be carried out either within the second ion trap 21 or in previous ion stages. For example, low mass cut off rf optics in the ion source 10, the first ion trap 20, or the second ion trap 21 may be employed to carry out coarse mass filtering. Alternatively, resonant excitation of certain mass to charge ratios may be employed within the ion source 10, the first ion trap 20, and/or the second ion trap 21. As a further alternative, a small DC voltage may be applied to a quadrupole to provide both low and high mass cut offs again either in the ion source 10, the first ion trap 20, or the second ion trap 21. The main requirement in any such incidence of pre-filtering is that, for every ion species of interest, the average ion number N in a pulse at the entrance to the fragmentation cell 50 should undergo small cumulative losses over the previous stages of the mass spectrometer 1. Mathematically, this may be expressed as $I_{in}>e.z.N.f>>I_{in}/G$. Here, e is the elementary charge (1.602×10-19 Coulomb), z is the charge state of an ion species having a particular m/z, f is the frequency of ejection from the second ion trap 21, and $I_{in}$ is the ion current on the exit from the ion source 10. With high frequency RF voltages applied to the first and second ion traps 20, 21 (for example, between 2 and 5 MHz), appropriate wide slots and correct synchronization, it is feasible to reach an ion current $I_{out}$=e.z.N.f=(0.2 . . . 0.5)$I_{in}$. In other words, embodiments of the present invention provide a benefit over triple quadrupoles even if only a limited number of precursors are selected.

The approach described above is also compatible with relatively slow fragmentation methods such as electron transfer dissociation (ETD), OzID (ozone-induced dissociation), IRMPD, UV dissociation, and so forth, and greatly enhances the utility of these "slow" fragmentation methods for targeted analysis. Currently, there is very limited use for such techniques in targeted analysis due to the long activation time necessary. To provide similar fragmentation efficiency for different precursors, each ETD experiment could be carried out for the same charge state of all ions, e.g. only ions with charge +3 would be selected for introduction into the fragmentation cell 50 in a first experiment, with +4 in a second experiment, etc. For IRMPD and UV dissociation, targeted precursors should in preference have similar dissociation constants (that is, cross sections) etc. It is possible also to have several different experiments of this type in each spectrum of the high resolution analyser.

Application of the methods described above is widespread. For example they may be used in peptide quantitation, analysis of complex mixtures in clinical, food, environmental and forensic applications. In use, the list of mass to charge ratios of precursors and fragments is uploaded into a computer (not shown) which directly or indirectly controls the controller 100, preferably together with corresponding retention times in a liquid chromatograph (LC) and their ranges of variation. Then, one full-MS spectrum without fragmentation is used to obtain an overview spectrum and an estimation of peak intensities. After that, one or multiple cycles using the techniques described above are carried out, depending upon AGC considerations as discussed. For mixtures of biopolymers such as peptides, it would be necessary to generate the list for each injection into the high resolution analyser in such a way that selected precursors have minimum overlap in their fragments, i.e. that for each precursor there should be at least one unique fragment that could confirm its identity along with the accurate mass of the precursor.

The method could also widely be applied without fragmentation, thus then providing reliable identification by the determination of an accurate mass of analytes, and by minimizing the risk of false positives because of the high resolving power at which analysis is carried out. One example includes a pseudo-panoramic mass spectrum of very high dynamic range, wherein the entire mass range is split into tens of hundreds of sub-ranges, each sub range being allocated a similar number of charges. Following gating of the ions in accordance with the allocated charges, a panoramic spectrum is acquired by the high resolution analyzer, with the most intense peaks in the original panoramic spectrum receiving a (much) lower number of injections compared with the least intense peaks. The acquired spectrum is then corrected according to this difference in the number of injections, thus restoring relative intensities of ions but also allowing the least intense peaks to be measured with a much higher signal to noise ratio if they fall outside of the vicinity of intense peaks.

Figure 3A:
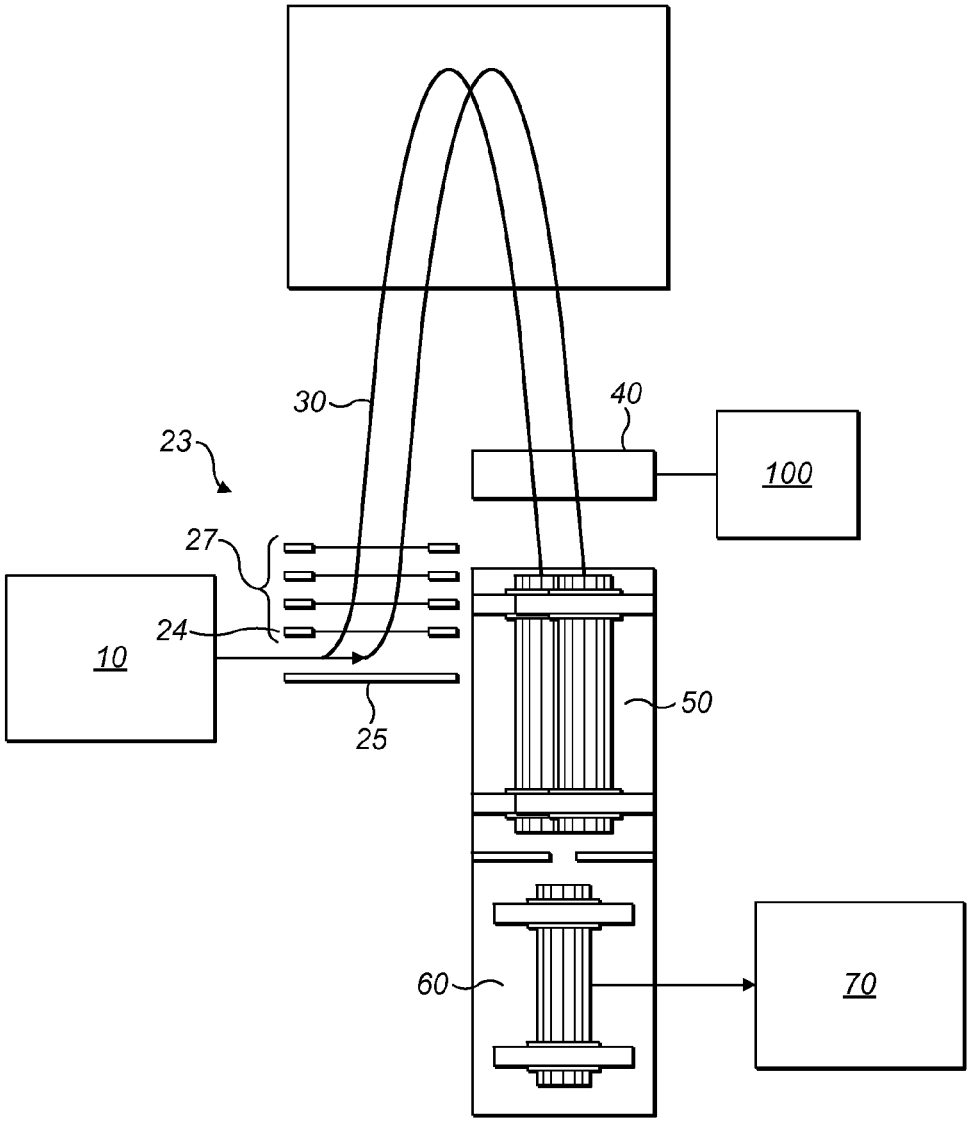
FIGS. 3*a* and 3*b* show, respectively, top and side views of a third embodiment of a tandem mass spectrometer for targeted analysis of precursor ions, including a non trapping ion accelerator.
Figure 3B:
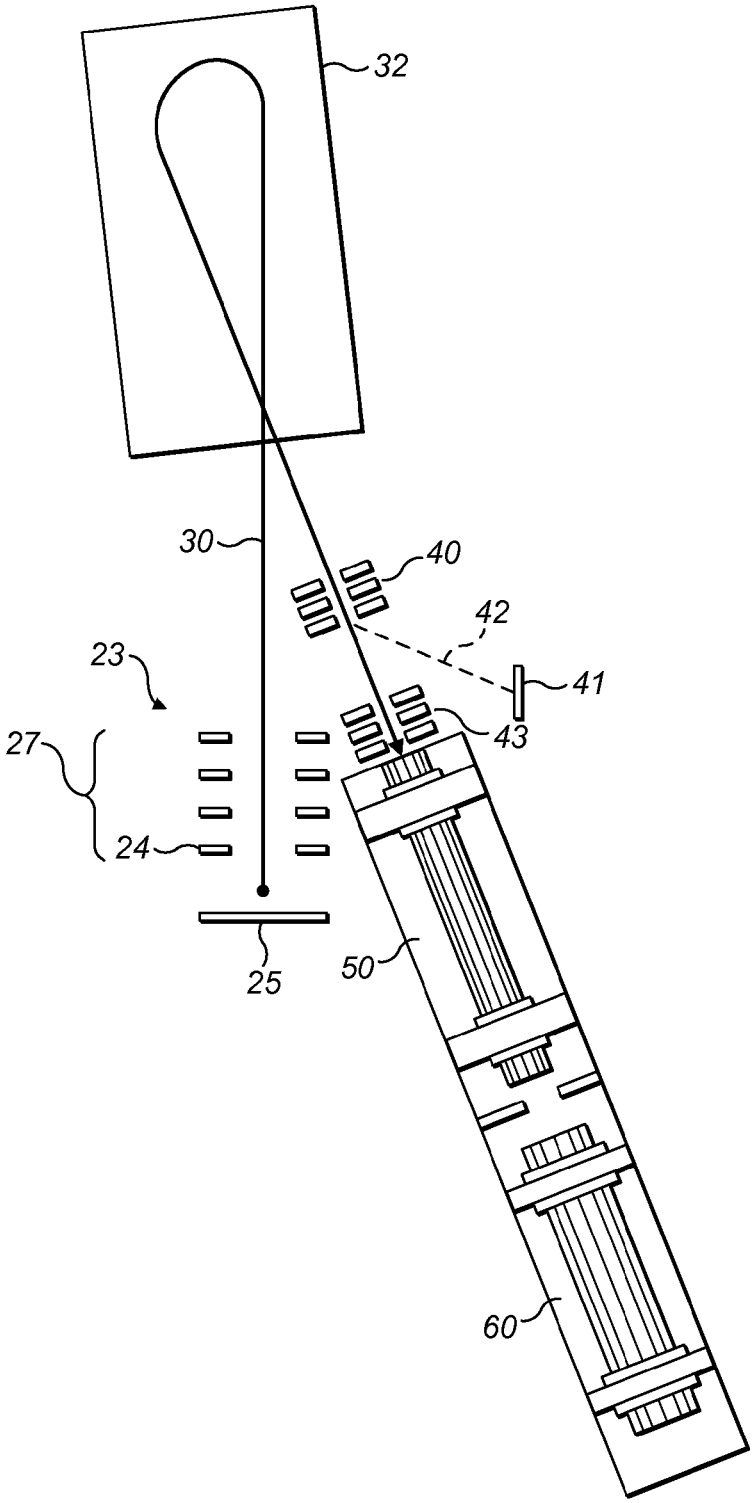

The embodiments of FIGS. 1 and 2 both show tandem mass spectrometers in which ions from the ion source 10 are trapped in a first ion trap 20 and then transmitted to a second ion trap 21 from where the ions are orthogonally ejected to the MR-TOF 30 (FIG. 1) or a collision cell 50 directly (FIG. 2). However in alternative arrangements in accordance with embodiments of the present invention, ions from the ion source are not subjected to an initial trapping stage but instead are directly injected into an orthogonal accelerator. FIGS. 3*a* and 3*b* show top and side views of one such arrangement for high throughput targeted analysis using a TOF analyser for precursor separation but employing a non-trapping orthogonal ejection device downstream of the ion source. Alternative arrangements of DC and RF orthogonal ejection devices, which again avoid initial trapping of ions from the ion source, are shown respectively in FIGS. 4*a* and 4*b*.

Referring then to FIGS. 3*a* and 3*b*, in more detail, a tandem mass spectrometer in accordance with a third embodiment of the present invention is shown. Components common to the embodiments of FIGS. 1, 2 and 3 are labelled with like reference numerals.

Ions are generated, as previously described, in the ion source 10. From there they are ejected into an orthogonal accelerator 23. In the embodiment of FIG. 3*a*, the orthogonal accelerator 23 is implemented as a pair of parallel plates 24, 25. The parallel plate 24 acts as an extraction plate having a grid or, most preferably, a slit for extraction of the beam, as is described for example in WO-A-01/11660. Ions enter the accelerator 23 when no DC voltage is applied across it. After a sufficient length of ion beam has entered the accelerator 23, a pulsed voltage is applied across the accelerator and ions are extracted via lenses 27 into a TOF analyser 30. Depending upon the quality of isolation required, the TOF analyser 30 may be a multi-reflection TOF, a multi deflection TOF or a single reflection TOF. A single reflection TOF is shown.

Due to the very high ion currents present, it is highly desirable that there are no grids in the ion path within the TOF 30, so as to avoid the presentation of metallic surfaces upon which ions may be deposited, in the ion path from source to detector. FIG. 3*b* is a side view of the tandem mass spectrometer in accordance with the third embodiment, using the example of a single-reflection TOF 30. As may be seen in FIG. 3*b*, ions follow a γ-shaped trajectory in the single reflection TOF 30, in a gridless mirror 32. Further details of the exemplary arrangement of TOF 30 as shown in FIG. 3*b* in particular are given in WO-A-2009/081143.

On the return path from the mirror 32, ions are gated by an ion gate 40, with ions of interest being allowed to enter a fragmentation cell 50 and undesired ions being deflected to an ion stop 41. Preferably, the ion gate 40 is gridless and contains a pulsed electrode 42 surrounded by apertures that limit the penetration of the field from the pulsed electrode 42. Optionally, these apertures could have time-dependant voltages applied to them, in order to compensate field penetration from the pulsed electrode 42.

After selection on the basis of their arrival time, ions enter a decelerating lens 43 where their energy is reduced to the desired value. Although not shown, the ions may also undergo deceleration prior to entry into the fragmentation cell 50 in the embodiments shown in FIGS. 1 and 2. Typically, the desired final energy for fragmentation might be estimated between 30-50 eV/kDa, where nitrogen or air is employed as a collision gas. This estimated final energy scales inversely proportional with gas mass, however, so that the final energy might exceed 100-200 eV/kDa if Helium is used as a collision gas. Similarly, for minimal or no fragmentation, the desired final energy is <10 eV/kDa where the collision gas is nitrogen or air, and <30-50 eV/kDa where Helium is employed as a collision gas. To allow deceleration to such low energies, it is preferable that ions are not excessively accelerated in the first place—preferably by not more than 300-500 V.

A typical example of a suitable deceleration lens is presented in P. O'Connor et al. *J. Amer. Soc. Mass Spectrom.*, 1991, 2, 322-335. For a 1 meter flight path in the TOF 30, a resolution of selection of 500-1000 is expected, which is considered adequate for most applications. Due to the γ-shape of the ion trajectory, ions arrive in the plane above the orthogonal accelerator 23 such that their initial energy can be chosen independently of the acceleration energy. This differs from conventional orthogonal acceleration TOFs, and allows an improvement in the duty cycle and transmission of ions. Typically, the TOF 30 operates at about a 10 kHz repetition rate so that each pulse ejects up to $10^5$-$10^6$ elementary charges.

Because the ion packets typically arrive at the fragmentation cell 50 as elongated threads, consideration should be given to a design of the fragmentation cell 50 so that it might accept such packets. In presently preferred embodiments, this is achieved by implementing the fragmentation cell 50 as an elongated collision cell with differential pumping, similar to the collision cell described in WO-A-04/083,805 and U.S. Pat. No. 7,342,224.

Following fragmentation in the fragmentation cell 50, ions are mixed together and analysed in the same manner as is described above in respect of the arrangements of FIGS. 1 and 2, by ejection into an optional external ion trapping device 60 with orthogonal ejection from that into a high resolution mass analyzer 70.

Figure 4A:
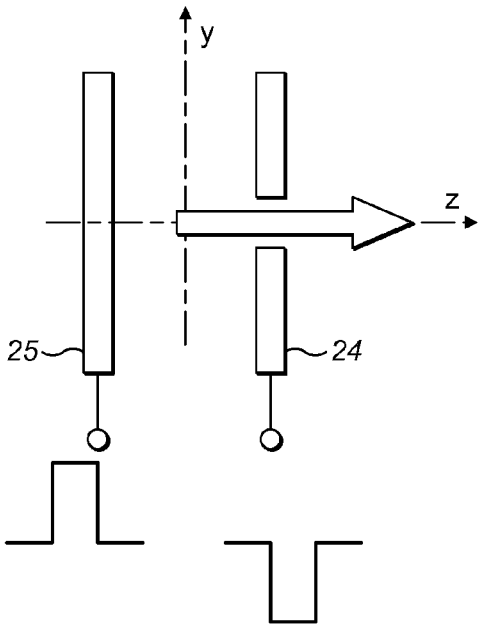
FIGS. 4*a* and 4*b* show, respectively, schematic views of DC and RF ion guides to provide an alternative means for orthogonal acceleration of ions to the non trapping ion accelerator of FIGS. 3*a* and 3*b*.
Figure 4B:
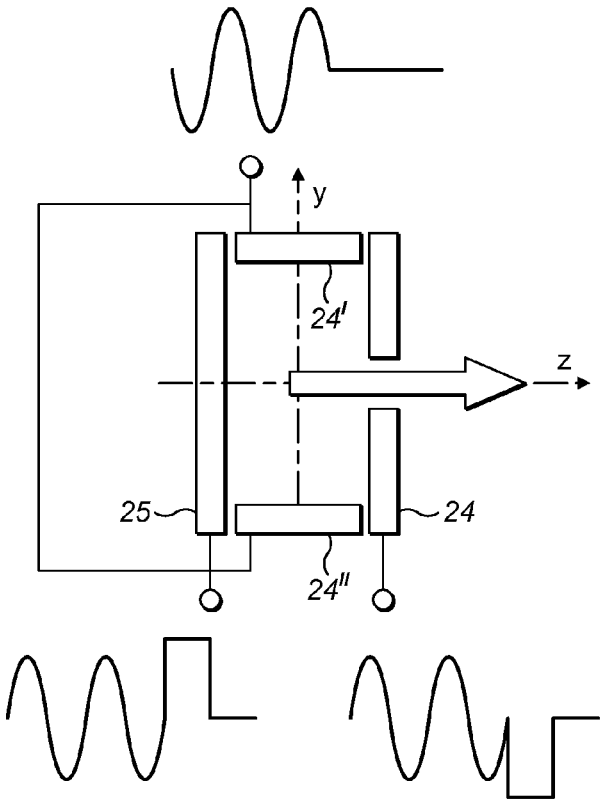

FIGS. 4*a* and 4*b* show first and second arrangements of non-trapping orthogonal ion accelerators 23 either of which may be employed as alternatives to the non-trapping orthogonal accelerator 23 of FIGS. 3*a* and 3*b*. The non-trapping ion accelerator of FIG. 4*a* is a DC ion guide whereas that of FIG. 4*b* is an RF ion guide.

In FIG. 4*a*, ions arrive from the ions source in a direction "y". The electrodes 25 and 24 (the latter of which has a central slot) are held at the same DC voltage until extraction voltage pulses are applied which result in ions being ejected in pulses through the slot in the electrode 24 in a direction "z" orthogonal to the input direction "y".

FIG. 4*b* shows another alternative arrangement in which, again, ions arrive from the ion source in a direction "y" and in which RF potentials on the electrodes 25, 24 are held the same until extraction pulses are applied. In particular, in FIG. 4*b*, in addition to the back plate and front extraction electrodes 25, 24, the accelerator 23 further comprises top and bottom electrodes 24' and 24" which utilize an RF phase which is opposite to that upon electrodes 24 and 25. U.S. Pat. No. 8,030,613 describes a technique for applying switchable RF to an ion trap. The technique described in this publication can however equally be applied to the non trapping RF only ion guide of FIG. 4*b* so that the RF is switchable off in accordance with the principles described in that document and pulses are applied to electrode 25 and/or 24 to extract the ions through the slot in the electrode 24.

In a preferred embodiment, the accelerator 23 of FIG. 4*b* in particular may be provided with a damping gas to reduce the energy spread of ions.

Whilst some specific embodiments have been described, those skilled in the art will readily appreciate that various modifications or additions may be contemplated. For example, not only might single- and multi-reflection mirrors be used in the arrangement of FIG. 1, but also multi-sector and orbital systems as well as ion mobility separators could be used. Additional detectors and analysers could be installed for added functionality. Further stages of mass selection may optionally be included between the ion source 10 and orthogonal accelerator 23, in the embodiments of FIGS. 3*a*, 3*b*, 4*a* and 4*b*.

The invention claimed is:

1. A method of analyzing substances by mass spectrometry, comprising the steps of:

(a) generating precursor ions in an ion source;

(b) guiding the precursor ions along an input axis into an ion accelerator;

(c) ejecting the precursor ions from the ion accelerator along an output axis towards a time-of-flight (TOF) mass analyser, wherein the output axis is substantially orthogonal with respect to the input axis;

(d) separating the precursor ions according to their mass-to-charge ratios (m/z's) in the TOF mass analyser, such that the precursor ions arrive at an ion gate located downstream of the TOF mass analyser as a temporally separated plurality of ion packets, each ion packet containing ions of a respective one of a plurality of different ion species;

(e) controlling the ion gate so as to sequentially select from the plurality of ion packets arriving at the ion gate, a subset of a plurality of ion packets deriving from a subset of precursor ion species of interest;

(f) mixing the selected subset of the plurality of ion packets; and (g) analyzing the resulting ion population derived from the mixed selected subset of ion packets in a high resolution mass analyzer.

2. The method of claim 1, further comprising, after selecting the subset of ion packets by controlling the ion gate, fragmenting at least some of the selected precursor ions.

3. The method of claim 2, wherein the step of fragmenting at least some of the selected precursor ions comprises fragmenting at least some of the different ion species at different times, using different respective fragmentation energies.

4. The method of claim 2, wherein the step of fragmenting at least some of the selected precursor ions comprises fragmenting the ions of each of the different precursor ion species at different times, using different respective optimized energies of fragmentation.

5. The method of claim 1, wherein step (f) comprises storing the selected subset of the plurality of ion packets in an ion accumulator.

6. The method of claim 1, further comprising accumulating in the ion accumulator, and over multiple cycles of the method steps (a) to (f), a desired number of ions for multiple precursor ion species of interest, the step (g) further comprising analyzing in parallel the accumulated selected ions.

7. The method of claim 2, further comprising accumulating, in the ion accumulator, and over multiple cycles of the method steps (a) to (f), the fragments of a desired number of ions for multiple precursor ion species of interest, the step (g) further comprising analyzing, in parallel, the accumulated fragment ions.

8. The method of claim 7, wherein the step of accumulating over multiple cycles comprises, during the step (e) of multiple cycles, controlling the ion gate so as to select ion packets containing different subsets of the plurality of precursor ion species, such that, over N cycles (N is an integer >1), ions of a first ion species $m_1/z_1$ are selected for fragmentation in M of those cycles (M is an integer ≤N) whereas ions of a second ion species $m_2/z_2$ are selected for fragmentation in a different number P of cycles (P is an integer; P≤N but P≠M).

9. The method of claim 8, further comprising selecting a number of cycles N of the method steps (a) to (f) for each m/z, in accordance with the intensity of each such m/z in the spectrum of ions generated by the ion source, such that more intense ions species are accumulated in fewer cycles than less intense ion species.

10. The method of claim 1, further comprising carrying out a preliminary mass analysis of all precursor ions to identify precursor ion species of interest and their relative abundances.

11. The method of claim 1, further comprising the steps of carrying out the steps (a) to (f) a plurality of times, in respect of a corresponding plurality of different subsets of ion packets; and combining the results of the analyses of the plurality of different subsets of ion packets by the high resolution mass analyser so as to form a composite mass spectrum.

12. A mass spectrometer comprising:

an ion source for generating precursor ions;

an ion accelerator arranged downstream of the ion source, the ion accelerator being positioned and oriented to receive the precursor ions along an input axis, the ion accelerator being configured to apply a potential to at least one electrode to cause the precursor ions to be ejected along an output axis substantially orthogonal to the input axis;

a time-of-flight (TOF) mass analyser positioned to receive precursor ions from the ion accelerator and being configured to separate the precursor ions according to their mass-to-charge ratios (m/z's) such that the precursor ions exit the TOF mass analyser as a temporally separated plurality of ion packets, each ion packet containing ions of a respective one of a plurality of different ion species;

an ion gate, positioned to receive the temporally separated plurality of ion packets from the TOF mass analyser;

an ion gate controller configured to control the ion gate so as to permit passage of only a subset of ion packets containing a respective subset of a plurality of precursor ion species of interest;

at least one of an ion guide and an ion trap for mixing the ions in the subset of ion packets passed by the ion gate; and a high resolution mass analyzer arranged to analyze the mixed ions or fragment ions derived therefrom.

13. The mass spectrometer of claim 12, wherein the at least one of an ion guide and an ion trap comprises a fragmentation cell.

14. The mass spectrometer of claim 12, wherein the TOF mass analyser comprises one of a single-reflection TOF mass analyser and a multi-reflection TOF mass analyser.

15. The mass spectrometer of claim 12, wherein the ion accelerator comprises first and second parallel plates, one of which forms an extraction plate.

16. The mass spectrometer of claim 15, wherein the extraction plate includes a grid or slit.

* * * * *